US005732602A

United States Patent [19]

Schwartz

[11] Patent Number: 5,732,602

[45] Date of Patent: Mar. 31, 1998

[54] HANDLE HAVING RESILIENT MATERIAL INCORPORATED THEREIN

[76] Inventor: Noah Schwartz, 196 Olney St., Providence, R.I. 02906

[21] Appl. No.: 614,285

[22] Filed: Mar. 12, 1996

[51] Int. Cl.[6] ..... G05G 1/10; B25G 1/01

[52] U.S. Cl. ..... 74/545; 74/548; 74/557; 16/116 R; 16/117

[58] Field of Search ..... 74/545, 543, 544, 74/546, 547, 548, 557; 16/116 R, 117, 118, DIG. 41

[56] References Cited

U.S. PATENT DOCUMENTS

| | | | |
|---|---|---|---|
| 1,859,038 | 5/1932 | Irgens | 74/543 X |
| 2,236,674 | 4/1941 | Davy . | |
| 2,488,159 | 11/1949 | Becker . | |
| 2,564,905 | 8/1951 | Kaye . | |
| 2,766,626 | 10/1956 | Ritter . | |
| 2,828,616 | 4/1958 | Zeigler et al. . | |
| 2,929,361 | 3/1960 | Reynolds et al. | 16/116 R |
| 3,315,540 | 4/1967 | Baumgartner . | |
| 4,044,625 | 8/1977 | D'Haem et al. | 16/116 R |
| 4,220,054 | 9/1980 | Kuhlman . | |
| 4,302,986 | 12/1981 | Shepherd . | |
| 4,445,529 | 5/1984 | Lagarelli | 74/557 X |
| 4,583,420 | 4/1986 | Miley . | |
| 4,648,468 | 3/1987 | Honsa | 16/116 R |
| 4,821,598 | 4/1989 | Yamazawa et al. . | |
| 4,899,854 | 2/1990 | Cartoni . | |
| 4,946,194 | 8/1990 | Maeda et al. . | |
| 4,976,801 | 12/1990 | Martine et al. . | |
| 5,050,446 | 9/1991 | Takashima et al. . | |
| 5,058,267 | 10/1991 | Andrä et al. . | |
| 5,157,807 | 10/1992 | Keller et al. | 16/116 R |
| 5,273,120 | 12/1993 | Chang | 16/116 R |

FOREIGN PATENT DOCUMENTS

| | | | |
|---|---|---|---|
| 0 156 387 | 10/1985 | European Pat. Off. | 16/116 R |

*Primary Examiner*—Charles A. Marmor
*Assistant Examiner*—Mary Ann Battista
*Attorney, Agent, or Firm*—Salter & Michaelson

[57] ABSTRACT

A handle has an inner hub member which engages a shaft and rotates about a longitudinal axis therewith, an outer hub member which is disposed around the inner hub member and is coaxial therewith, and resilient material disposed in a space between the inner and outer hub members. The resilient material effects the transfer of rotational movement between the inner and outer hub members, and under normal operating conditions, the outer hub member is generally coaxial with the inner hub member and rotates in a tangential direction to effect the rotation of the inner hub member and the shaft. Thus, upon the rotation or movement of the outer hub member in a direction other than the tangential direction which results in the outer hub member extending along an axis angled to the longitudinal axis of the inner hub member, the inner hub member maintains its direction along the longitudinal axis by virtue of the resilient material disposed between the inner and outer hub members.

18 Claims, 3 Drawing Sheets

HANDLE HAVING RESILIENT MATERIAL INCORPORATED THEREIN

BACKGROUND AND SUMMARY OF THE INVENTION

This invention relates generally to operating handles, and more particularly to a handle for operating equipment, such as photography equipment, pressurized containers, and the like, which has a shock absorption member incorporated therein for enabling the handle to deflect when a force is applied thereto without bending a shaft on which it is mounted.

Handles for rotating shafts and other devices are well-known in the art. Reference can be made to any of the U.S. Pat. No. 2,236,674 to Davy, U.S. Pat. No. 2,488,159 to Becker, U.S. Pat. No. 2,564,905 to Kaye, U.S. Pat. No. 2,828,616 to Zeigler et al., U.S. Pat. No. 4,821,598 to Yamazawa, and U.S. Pat. No. 4,976,801 to Martine et al., as representative prior art in this field.

The present invention is directed to a handle attached to a shaft rotatable about a longitudinal axis, the handle comprising an inner hub member which engages the shaft and rotates about the longitudinal axis therewith, an outer hub member which is disposed around the inner hub member and is coaxial therewith in such a manner that there is a space between the inner and outer hub members, and resilient material disposed in the space between the inner and outer hub members. The resilient material effects the transfer of rotational movement between the inner hub member and the outer hub member wherein under normal operating conditions, the outer hub member is generally coaxial with the inner hub member and rotates in a tangential direction to effect the rotation of the inner hub member and the shaft. Thus, upon the rotation or movement of the outer hub member in a direction other than the tangential direction which results in the outer hub member extending along an axis angled to the longitudinal axis of the inner hub member, the inner hub member maintains its direction along the longitudinal axis by virtue of the resilient material disposed between the inner and outer hub members.

In another aspect of the present invention, a handle comprises a shaft mounting portion having an inner hub member which engages the shaft and rotates about the longitudinal axis therewith, an outer hub member which is disposed around the inner hub member and is coaxial therewith in such a manner that there is a space between the inner and outer hub members, and resilient material disposed in the space between the inner and outer hub members. The resilient material effects the transfer of rotational movement between the inner hub member and the outer hub member. The handle further comprises interconnecting means fixedly attached to and extending radially from the outer hub member, and grip means fixedly attached to the interconnecting means. The grip means is adapted to be gripped by a person's hand and moved in a tangential direction with respect to the shaft for rotating the inner and outer hub members of the shaft mounting portion and thereby rotating the shaft. Thus, under normal operating conditions, the outer hub member is generally coaxial with the inner hub member, and upon the rotation or movement of the grip means in a direction other than the tangential direction which results in the outer hub member extending along an axis angled to the longitudinal axis of the inner hub member, the inner hub member maintains its direction along the longitudinal axis by virtue of the resilient material disposed between the inner and outer hub members thereby preventing damage from occurring to the shaft.

Accordingly, among the several objects of the present invention are the provision of a handle having resilient material incorporated therein which is capable of withstanding impacts that would otherwise cause a shaft on which the handle is mounted to bend; the provision of such an improved handle which is sturdy; the provision of such a handle which can be used on pressurized canisters; the provision of such a handle which can be used on metal working machinery; and the provision of such a handle which is simple in construction and easy to manufacture.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several, views of the drawings.

DETAILED DESCRIPTION OF THE PREFERRED EMBODIMENTS

Figure 2:
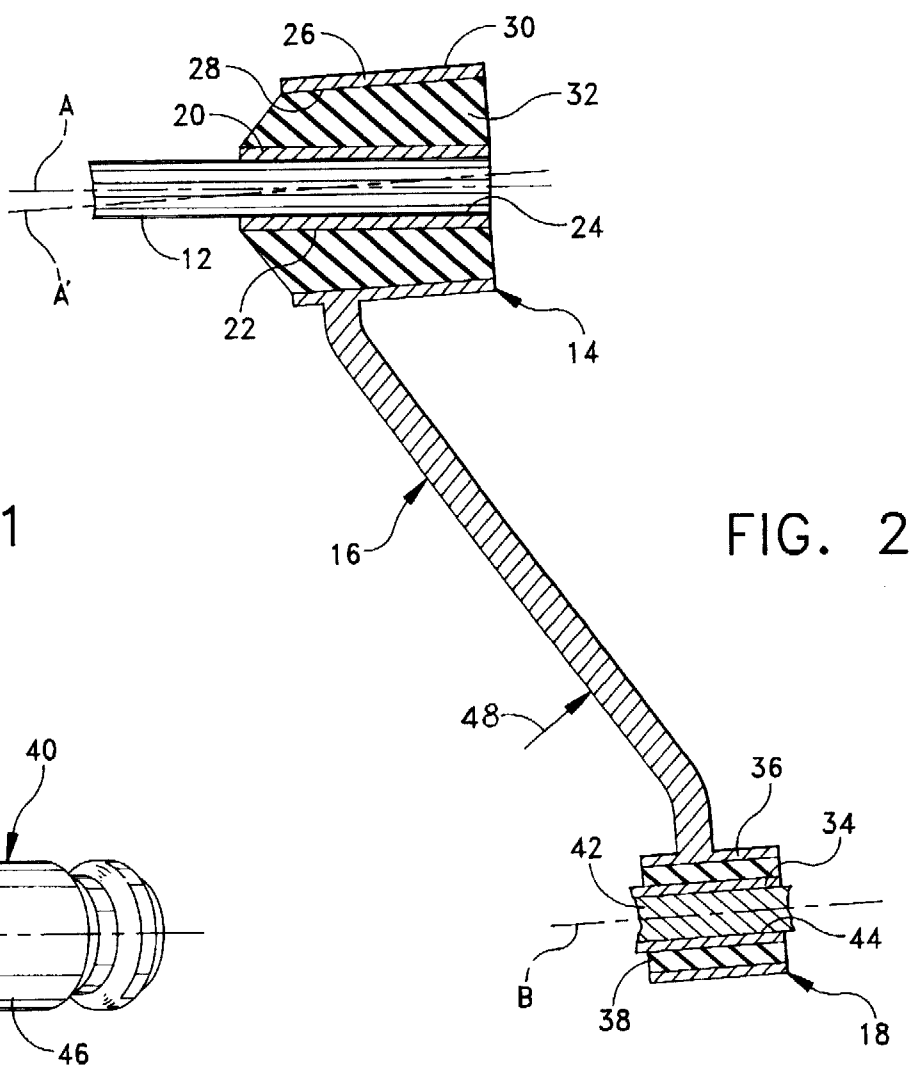
FIG. 2 is a cross-sectional view taken along line 2—2 of FIG. 1.
Figure 1:
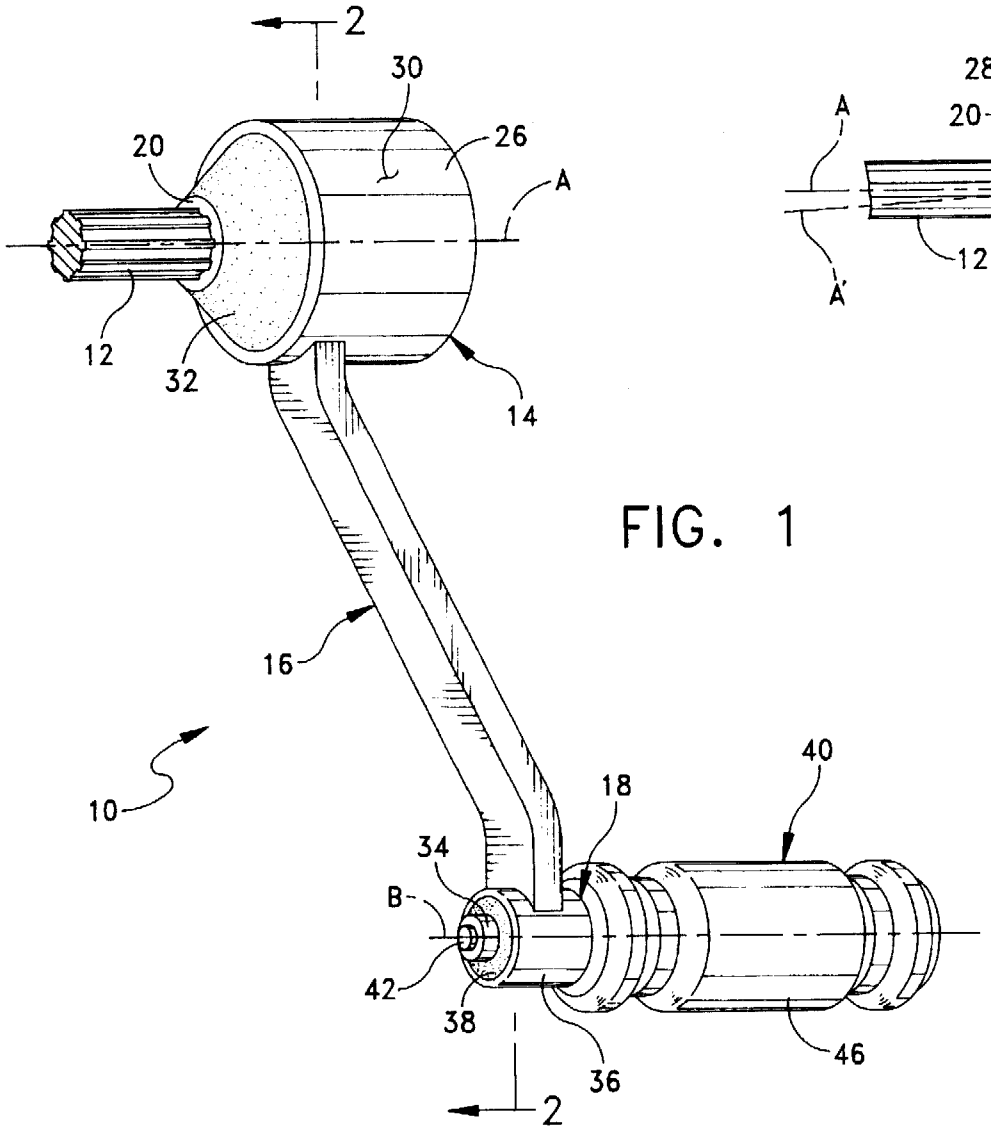
FIG. 1 is a perspective view of a handle having resilient material of the present invention.

Referring now to the drawings, and more particularly to FIGS. 1 and 2, there is generally indicated at 10 a handle which is attached to a shaft 12, and rotatable about a longitudinal axis A. The handle 10 is provided for rotating the shaft 12 about its axis A in the well-known manner. However, the handle 10 is especially suited for equipment having elongated shafts, such as camera and lighting equipment, which are subjected to rough handling and the like. More specifically, the handle 10 of the present invention resists bending the shaft 12 on which it is mounted when the handle 10 is subjected to sudden impacts or movements in directions other than the tangential direction of the shaft 12.

The handle 10 embodied in FIGS. 1 and 2 comprises three main component parts—namely, a shaft mounting portion, generally indicated at 14, an interconnecting portion, generally indicated at 16, and a grip portion, generally indicated at 18. The shaft mounting portion 14 has a cylindrically-shaped inner hub member 20 which engages the shaft 12 and rotates about the axis A. The inner hub member 20 has a smooth outer surface 22 and an inner surface 24 which has formations (not designated) that mate with formations (not designated) of the shaft 12 for interconnecting the inner hub member 20 with the shaft 12. The arrangement is such that the shaft 12 rotates upon the rotation of the inner hub member 20. The provision of interengaging formations on the shaft 12 and inner hub member 20 is well-known in the art of rotational transmission apparatus.

The shaft mounting portion 14 further includes a cylindrically-shaped outer hub member 26 which is disposed around the inner hub member 20 and is coaxial therewith along axis A in such a manner that there is a space between the inner and outer hub members 20, 26. The outer hub member 26 has a smooth inner surface 28 which faces the outer surface 22 of the inner hub member 20, and a smooth outer surface 30. Preferably, the inner and outer hub members 20, 26 are fabricated from rigid material, such as stainless steel. As illustrated best in FIG. 2, the inner hub member 20 has a longer lengthwise dimension than the outer hub member 26 wherein the upper end of the inner hub member 20 extends beyond the corresponding end of the outer hub member 26.

Resilient material 32 of the present invention is disposed in the space between the inner and outer hub member 20, 26. The resilient material 32 effects the transfer of rotational movement between the inner and outer hub members 20, 26 whereby upon the outer hub member 26 being rotated, the inner hub member 20 and shaft 12 in turn rotate. The resilient material 32 is preferably fabricated from rubber or silicon having a high durometer which is resilient enough to withstand rotational movements or impacts in a direction other than the tangential direction of the outer hub member 26, inner hub member 20, and shaft 12, but strong enough so that it transfers rotational movement in the tangential direction. It has been discovered that the surface tension of the resilient material 32 is strong enough to transmit rotational movement from the outer hub member 26 to the inner hub member 20 even though the outer surface 22 of the inner hub member 20 and the inner surface 28 of the outer hub member 26 are both smooth.

The interconnecting portion 16 of handle 10 serves as an arm which extends radially from the outer hub member 26 of the shaft mounting portion 14, and connects the outer hub member 26 to the grip portion 18. More specifically, the grip portion 18 is constructed similarly to the shaft mounting portion 14, it also having a cylindrically-shaped inner hub member 34, a cylindrically-shaped outer hub member 36 which is disposed around the inner hub member 34 and coaxial therewith, and resilient material 38 disposed in the space between the inner and outer hub members 34, 36. The interconnecting portion 16 is integrally formed with outer hub member 26 of the shaft mounting portion 14 and the outer hub member 36 of the grip portion 18. Preferably, the shaft mounting, interconnecting and grip portions 14, 16, 18 are welded together and chrome plated for enhancing the appearance of the handle 10.

Still referring to FIGS. 1 and 2, the inner hub member 34 of the grip portion 18 receives therein a handle assembly generally indicated at 40 which has a shaft portion 42 that extends along axis B through an elongate bore 44 defined by the cylindrically-shaped inner hub member 34. The handle assembly 40 further includes an elongate hand engagement portion 46 which is rotatably mounted in any suitable manner to the shaft portion 42, and is formed to be gripped by a person's hand and moved in a tangential direction with respect to the shaft 12 for rotating the inner and outer hub members 20, 26 of the shaft mounting portion 14. This tangential movement of the grip portion 18 causes the rotation of the shaft 12.

The arrangement is such that under normal operating conditions, the outer hub member 26 of the shaft mounting portion 14 is generally coaxial with its inner hub member 20 when moving the grip portion 18 in the aforementioned tangential direction. However, upon the rotation or movement of the grip portion 18 in a direction other than the tangential direction, e.g., in the direction indicated by arrow 48 in FIG. 2, thereby resulting in the outer hub member 26 extending along an axis A', the inner hub member 20 maintains its direction along the longitudinal axis A by virtue of the resilient material 32 disposed between the inner and outer hub members 20, 26. Thus, the resilient material 32 prevents damage from occurring to the shaft 12 since it absorbs the undesired forces transferred to the outer hub member 26, e.g., forces indicated by arrow 48, which are applied to either the interconnecting portion 16 or the grip portion 18.

It should be pointed out that the inner and outer hub members 34, 36 of the grip portion 18, upon shaft portion 42 of the handle assembly 40 moving in a non-tangential direction with respect to the shaft portion 42, function in an identical fashion with respect to the inner and outer hub members 20, 26 of the shaft mounting portion 14.

Figure 3:
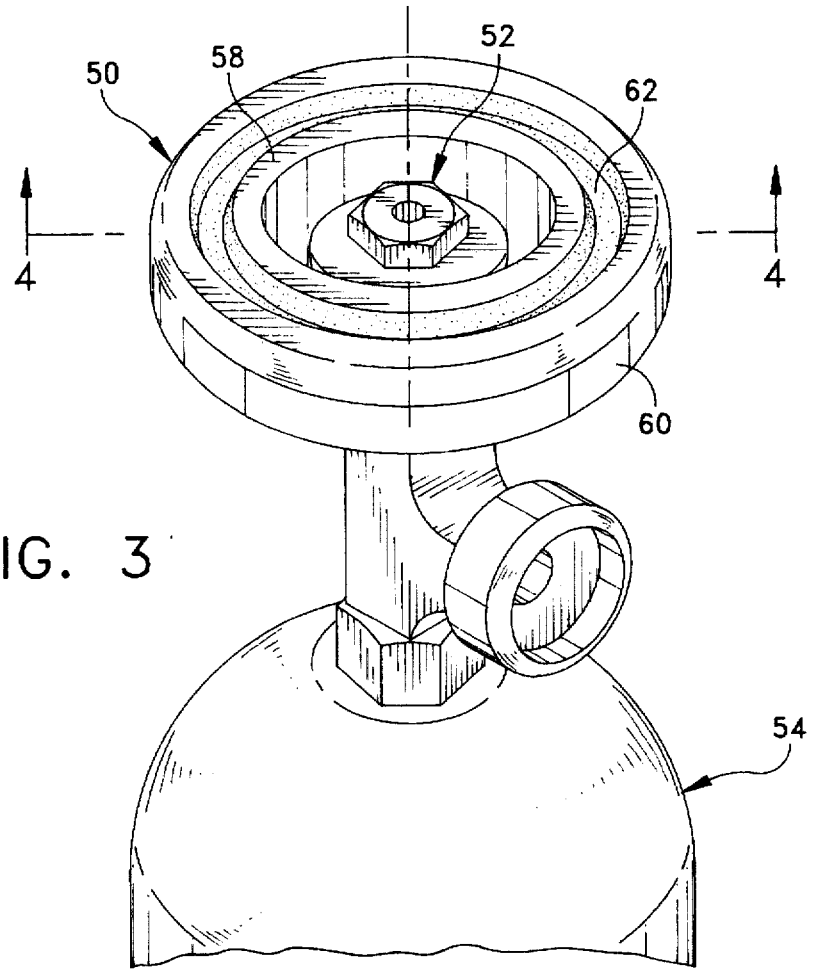
FIG. 3 is a perspective view of a handle of another preferred embodiment, the handle being mounted on a pressurized canister.
Figure 4:
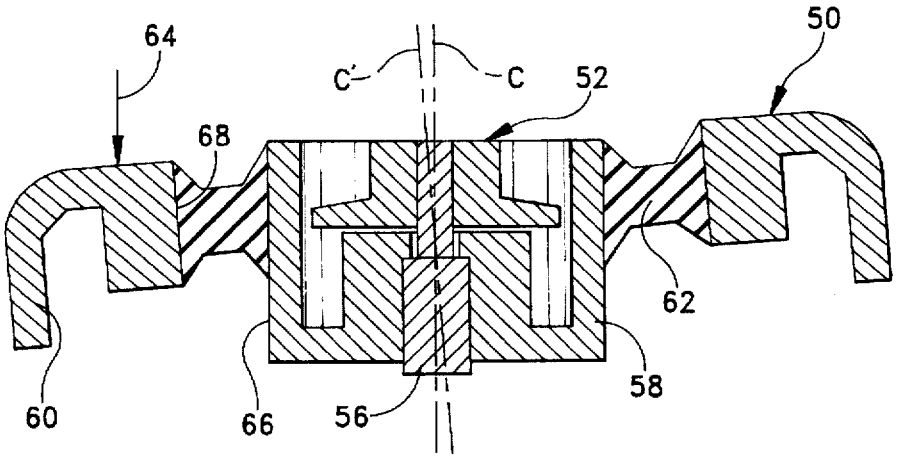
FIG. 4 is a cross-sectional view taken along line 4—4 of FIG. 3.

Turning now to FIGS. 3 and 4, there is generally indicated at 50 a handle of another preferred embodiment of the present invention. More specifically, handle 50 is attached to a valve member generally indicated at 52 of a pressurized canister which is generally indicated at 54 in FIG. 3, for opening and closing the valve member 52 in a manner well-known in the art. The handle 50 is rotatably connected to a shaft 56 of the valve member 52 and is rotatable about a longitudinal axis C. The handle 50 comprises an inner hub member 58 which engages the shaft 56 and rotates about the axis C, an outer hub member 60 which is disposed around the inner hub member 58 and is coaxial therewith in such a manner that there is a space between the inner and outer hub members 58, 60, and resilient material 62 disposed in the space between the inner and outer hub members. As with the resilient material 32 of handle 10, the resilient material 62 effects the transfer of rotational movement between the inner hub member 58 and the outer hub member 60.

As illustrated best in FIG. 4, under normal operating conditions, the outer hub member 60 is generally coaxial with the inner hub member 58 along axis C and is capable of being rotated in a tangential direction to effect the rotation of the inner hub member 58 and the shaft 56 of the valve member 52. This action either opens or closes the valve member 52 of the pressurized canister 54. Upon the rotation or movement of the outer hub member 60 in a direction other than the tangential direction, which movement is represented by arrow 64 in FIG. 4, the outer hub member 60 extends along an axis C' which is angled to the longitudinal axis C of the inner hub member 58. As with handle 10, the inner hub member 58 maintains its direction along the longitudinal axis C by virtue of the resilient material 62 disposed between the inner and outer hub members 58, 60. Thus, the valve member 52 and its shaft 56 are protected by the resilient material 62 disposed between the inner and outer hub members 58, 60 from any movement which would cause the shaft 56 to bend or break.

The outer surface 66 of the inner hub member 58 and the inner surface 68 of the outer hub member 60 of handle 50 are also smooth. The resilient material 62 of handle 50 is fabricated from rubber or silicon having a high durometer which is resilient enough to withstand rotational movements or impacts of the outer hub member 60 in a direction other than the tangential direction but strong enough so that it transfers rotational movement in the tangential direction. The surface tension of the resilient material on the smooth surfaces 66, 68 of the inner and outer hub members 58, 60, respectively, is sufficiently strong enough to effect the transfer of rotational movement therebetween. As shown, the cross-sectional shape of the resilient material 62 enables it to move when the outer hub member 60 is impacted by a force represented by arrow 64 without engaging the inner hub member 58.

Figure 5:
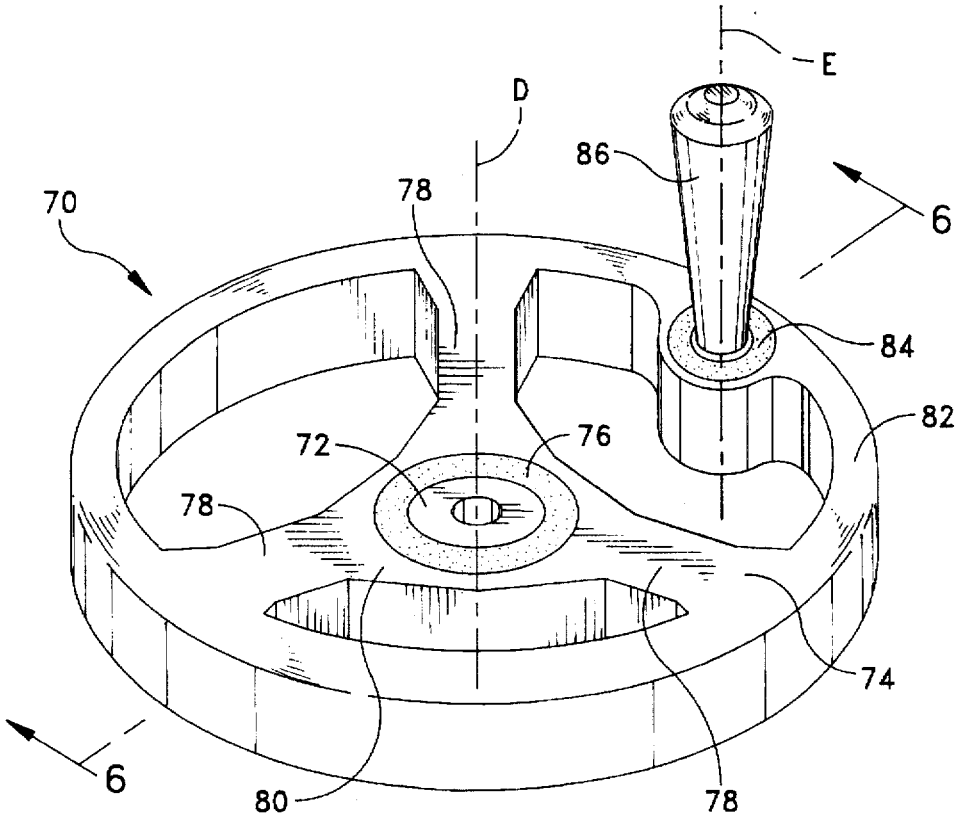
FIG. 5 is a perspective view of a handle of yet another preferred embodiment.
Figure 6:
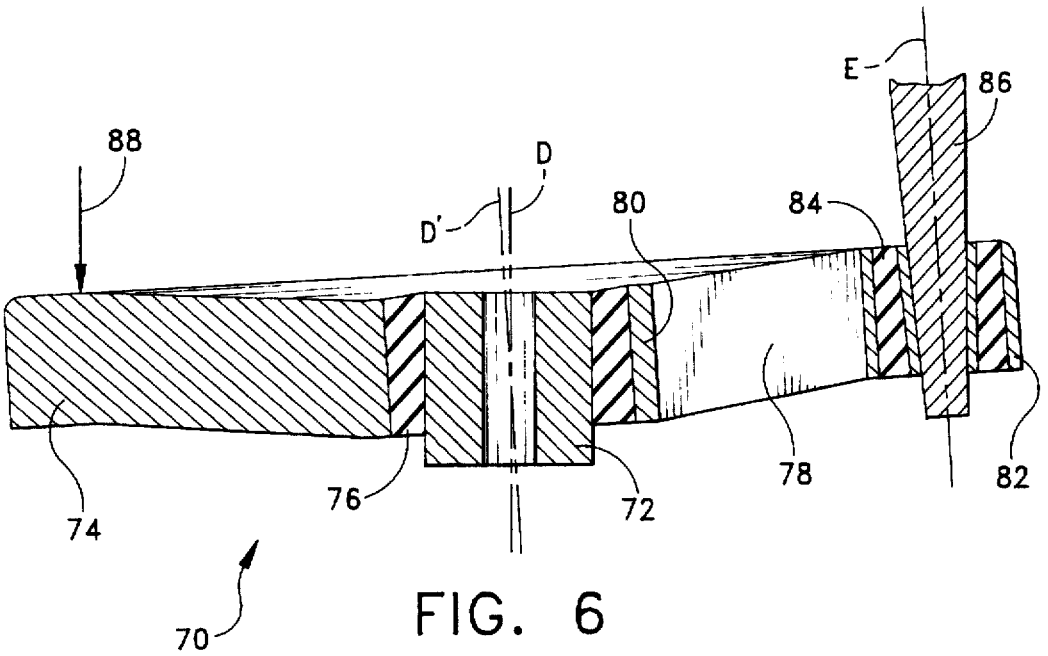
FIG. 6 is a cross-sectional view taken along line 6—6 of FIG. 5.

FIGS. 5 and 6 illustrate a handle generally indicated at 70 which is a modified version of handle 50 and is especially suited for use on metal working machinery, such as a lathe or drill press. Handle 70 is rotatable about a longitudinal axis D and comprises an inner hub member 72 which engages a shaft (not shown) and rotates about the axis D, an outer hub member 74 which is disposed around the inner hub member 72 and is coaxial therewith in such a manner that there is a space between the inner and outer hub members 72, 74, and resilient material 76 disposed in the space between the inner and outer hub members 72, 74. In this embodiment, the outer hub member 74 is shaped to have three spokes 78 which are integrally formed so as to interconnect an inner ring 80 which engages the resilient material 76 to an outer ring 82 of the outer hub member 74. As with handle 10, the resilient material 76 effects the transfer of rotational movement between the inner hub member 72 and the outer hub member 74.

The handle 70 of the embodiment illustrated in FIGS. 5 and 6 further comprises an interconnecting portion having resilient material 84. This resilient material 84 connects the outer ring 82 of the outer hub member 74 to grip portion comprising a handle 86 which extends along axis E in a direction generally perpendicular with respect to the plane of the outer hub member 74. The resilient material 84 enables the handle 86 to move slightly about its axis E without causing damage to the outer hub member 74.

As illustrated best in FIG. 6, under normal operating conditions, the outer hub member 74 is generally coaxial with the inner hub member 72 about axis D and is capable of being rotated in a tangential direction to effect the rotation of the inner hub member 72 and the shaft upon which it is attached. Upon the rotation or movement of the outer hub member 74 in a direction other than the tangential direction, which is represented by arrow 88 in FIG. 6, the outer hub member 74 extends along an axis D' which is angled to the longitudinal axis D of the inner hub member 72. As with handles 10 and 50, the inner hub member 72 of handle 70 maintains its direction along the longitudinal axis D by virtue of the resilient material 76 disposed between the inner and outer hub members 72, 74.

Thus, it should be pointed out that the handles 10, 50, and 70 illustrated in FIGS. 1 and 2, FIGS. 3 and 4, and FIGS. 5 and 6, respectively, enable a person to rotate a shaft upon which the handles are mounted without fear or trepidation that any movement in a direction other than the tangential direction will result in damage to the shaft.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A handle attached to a shaft rotatable about a longitudinal axis comprising an inner hub member which engages the shaft and is fixedly attached to the shaft so that it rotates about said longitudinal axis with the shaft, an outer hub member which is disposed around the inner hub member and is coaxial therewith in such a manner that there is a space between the inner and outer hub members, and resilient material disposed in the space between the inner and outer hub members, said resilient material effecting the transfer of rotational movement between the inner hub member and the outer hub member, wherein under normal operating conditions, the outer hub member is generally coaxial with the inner hub member and rotates in a tangential direction to effect the rotation of the inner hub member and the shaft, and upon the rotation or movement of the outer hub member in a direction other than said tangential direction which results in the outer hub member extending along an axis angled to said longitudinal axis of the inner hub member, the inner hub member maintains its direction along said longitudinal axis by virtue of the resilient material disposed between the inner and outer hub members.

2. A handle as set forth in claim 1, said inner hub member being cylindrically-shaped and having an inner surface and an outer surface which is relatively smooth.

3. A handle as set forth in claim 2, said inner surface of the inner hub member being formed with formations which mate with formations of the shaft for interconnecting the inner hub member with the shaft.

4. A handle as set forth in claim 2, said outer hub member being cylindrically-shaped.

5. A handle as set forth in claim 4, said outer hub member having an inner surface which is relatively smooth, said resilient material being disposed between the smooth outer surface of the inner hub member and the smooth inner surface of the outer hub member.

6. A handle as set forth in claim 1, said resilient material being fabricated from rubber or silicon having a high durometer which is resilient enough to withstand rotational movements or impacts of the outer hub member in a direction other than said tangential direction but strong enough so that it transfers rotational movement in said tangential direction.

7. A handle attached to a shaft rotatable about a longitudinal axis, said handle comprising:

a shaft mounting portion having an inner hub member which engages the shaft and is fixedly attached to the shaft so that it rotates about said longitudinal axis with the shaft, an outer hub member which is disposed around the inner hub member and is coaxial therewith in such a manner that there is a space between the inner and outer hub members, and resilient material disposed in the space between the inner and outer hub members, said resilient material effecting the transfer of rotational movement between the inner hub member and the outer hub member;

interconnecting means fixedly attached to and extending radially from the outer hub member; and grip means fixedly attached to the interconnecting means, said grip means being adapted to be gripped by a person's hand and moved in a tangential direction with respect to the shaft for rotating the inner and outer hub members of the shaft mounting portion and thereby rotating said shaft, wherein under normal operating conditions, the outer hub member is generally coaxial with the inner hub member, and upon the rotation or movement of the grip means in a direction other than said tangential direction which results in the outer hub member extending along an axis angled to said longitudinal axis of the inner hub member, the inner hub member maintains its direction along said longitudinal axis by virtue of the resilient material disposed between the inner and outer hub members thereby preventing damage from occurring to the shaft.

8. A handle as set forth in claim 7, said inner hub member of the shaft mounting portion being cylindrically-shaped and having an inner surface, and an outer surface which is relatively smooth.

9. A handle as set forth in claim 8, said inner surface of the inner hub member of the shaft mounting portion being formed with formations which mate with formations of the shaft for interconnecting the inner hub member with the shaft.

10. A handle as set forth in claim 8, said outer hub member being cylindrically-shaped.

11. A handle as set forth in claim 10, said outer hub member having an inner surface which is relatively smooth, said resilient material being disposed between the smooth outer surface of the inner hub member and the smooth inner surface of the outer hub member.

12. A handle as set forth in claim 11, said inner hub member having a longer lengthwise dimension than the outer hub member wherein one end of the inner hub member extends beyond the corresponding end of the outer hub member, said resilient material extending between the respective ends of the inner and outer hub members.

13. A handle as set forth in claim 10, said interconnecting means comprising resilient material for connecting the outer hub member of the shaft mounting portion to the grip means.

14. A handle as set forth in claim 13, said grip means comprising a handle assembly which extends in a direction generally perpendicular to the outer hub member of the shaft mounting portion.

15. A handle as set forth in claim 7, said resilient material being fabricated from rubber or silicon having a high durometer which is resilient enough to withstand rotational movements or impacts of the grip means in a direction other than said tangential direction but strong enough so that it transfers rotational movement in said tangential direction.

16. A handle as set forth in claim 7, said grip means comprising an inner hub member, an outer hub member which is disposed around the inner hub member and is coaxial therewith, said outer hub member being fixedly attached to said interconnecting means, and resilient material disposed in the space between the inner and outer hub members.

17. A handle as set forth in claim 16, said inner hub member of the grip means being connected to a handle assembly of said grip means, said handle assembly having a shaft portion which extends through an elongate bore defined by the grip means inner hub member.

18. A handle attached to a shaft rotatable about a longitudinal axis, said handle comprising:

a shaft mounting portion having an inner hub member which engages the shaft and rotates about said longitudinal axis therewith, an outer hub member which is disposed around the inner hub member and is coaxial therewith in such a manner that there is a space between the inner and outer hub members, and resilient material disposed in the space between the inner and outer hub members, said resilient material effecting the transfer of rotational movement between the inner hub member and the outer hub member;

interconnecting means fixedly attached to and extending radially from the outer hub member; and grip means fixedly attached to the interconnecting means, said grip means being adapted to be gripped by a person's hand and moved in a tangential direction with respect to the shaft for rotating the inner and outer hub members of the shaft mounting portion and thereby rotating said shaft, said grip means comprising an inner hub member, an outer hub member which is disposed around the inner hub member and is coaxial therewith, said outer hub member being fixedly attached to said interconnecting means, and resilient material disposed in the space between the inner and outer hub members, wherein under normal operating conditions, the outer hub member is generally coaxial with the inner hub member, and upon the rotation or movement of the grip means in a direction other than said tangential direction which results in the outer hub member extending along an axis angled to said longitudinal axis of the inner hub member, the inner hub member maintains its direction along said longitudinal axis by virtue of the resilient material disposed between the inner and outer hub members thereby preventing damage from occurring to the shaft.

* * * * *